US005868465A

United States Patent [19]

Kvalvik

[11] Patent Number: 5,868,465

[45] **Date of Patent: *Feb. 9, 1999**

[54] CHILD'S SEATING RESTRAINT

[76] Inventor: Prerna J. Kvalvik, 1108 Lawrence St., New London, Wis. 54961

[ * ] Notice: The term of this patent shall not extend beyond the expiration date of Pat. No. 5,713,630.

[21] Appl. No.: 953,981

[22] Filed: Oct. 20, 1997

Related U.S. Application Data

[63] Continuation-in-part of Ser. No. 740,144, Oct. 22, 1996, Pat. No. 5,713,630.

[51] Int. Cl.[6] ..... A47C 1/08

[52] U.S. Cl. ..... 297/253; 297/467; 297/228.1; 297/228.13

[58] Field of Search ..... 297/254, 250.1, 297/252, 253, 256.15, DIG. 1, 228.1, 225, DIG. 6, 228.13

[56] References Cited

U.S. PATENT DOCUMENTS

| | | |
|---|---|---|
| 1,373,200 | 3/1921 | Pacht . |
| 2,475,962 | 7/1949 | Horn . |
| 2,652,183 | 9/1953 | Hlivka . |
| 2,851,084 | 9/1958 | Benjetsky . |
| 3,014,761 | 12/1961 | Otto . |
| 3,366,294 | 1/1968 | Stephenson . |
| 4,047,757 | 9/1977 | Eames et al. . |
| 4,235,474 | 11/1980 | Rosenberg . |
| 4,324,430 | 4/1982 | Dimas, Jr. et al. . |
| 4,568,125 | 2/1986 | Sckolnik . |
| 4,759,588 | 7/1988 | Husnik . |
| 4,871,210 | 10/1989 | Alexander et al. . |
| 4,874,203 | 10/1989 | Henley . |
| 5,042,878 | 8/1991 | Collins . |
| 5,226,698 | 7/1993 | Harrison . |
| 5,265,933 | 11/1993 | Croshaw . |
| 5,335,968 | 8/1994 | Sheridan et al. . |
| 5,354,121 | 10/1994 | Allum . |
| 5,499,860 | 3/1996 | Smith et al. . |
| 5,639,145 | 6/1997 | Alderman . |
| 5,713,630 | 2/1998 | Kvalvik . |

FOREIGN PATENT DOCUMENTS

| | | |
|---|---|---|
| 815007 | 6/1959 | United Kingdom . |
| 1032588 | 6/1966 | United Kingdom . |
| 1176417 | 1/1970 | United Kingdom . |

*Primary Examiner*—Milton Nelson, Jr.
*Attorney, Agent, or Firm*—Jacobson, Price, Holman & Stern, PLLC

[57] ABSTRACT

A child's seating restraint is removably anchorable to a stationary article of furniture, such as a couch, sofa, or similar furniture typically found in the household. The restraint in turn provides for the removable securing of an infant, toddler, or small child thereto, to prevent the child from falling from furniture inadvertently. The seating restraint includes a belt secured to the back portion thereof. A continuous, unitary seat bottom and seat back portion is formed of a soft, pliable, resilient and washable material such as a closed cell foam plastic. A washable fabric cover may be provided for the seat bottom and/or seat back portion of the device. A crotch strap may be attached to the belt (or beneath the seat bottom), to extend from the back of the belt (or from the seat bottom) to a front loop through which the belt portions are passed. An alternate embodiment includes at least one J-shaped hook extending rearwardly from the seat back portion for anchoring the seat back portion to a piece of furniture. Alternatively, a sheet of material extends from the seat bottom for passing around a furniture cushion to anchor the seating restraint, and therefore a child, to the furniture. The child seating restraint provides a convenient and economical method for a parent or guardian to keep track of a small child which is beginning to develop mobility, while assuring that the child does not endanger him or herself.

12 Claims, 7 Drawing Sheets

CHILD'S SEATING RESTRAINT

This application is a continuation-in-part of application Ser. No. 08/740,144, filed Oct. 22, 1996, now U.S. Pat. No. 5,713,630.

BACKGROUND OF THE INVENTION

Field of the Invention

The present invention relates generally to seat belts, harnesses, and other restraining devices for infants, toddlers, and small children, and more specifically to a restraint which is adapted to be removably secured to an article of furniture such as a couch, chair or upholstered chair or the like. The restraint generally comprises a belt portion including furniture attachment means thereon. The belt may include a seat portion attached thereto, with the seat portion being removably attachable to the couch or chair.

Alternatively, the seat portion may include a securing device for removably securing the seat portion to a back portion of a couch or upholstered chair. In addition, two sets of straps are provided for surrounding a chair and securing the seat portion to the chair.

Additionally, a sheet of fabric is attached to a rear edge of the child seat. This sheet of fabric is laid under a seat cushion upon which the child seat is placed. The weight of the child and the child seat on the cushion anchor the sheet of material, and therefore the child in place.

An infant, toddler, or small child may be secured to the furniture by means of at least one of the restraints, to prevent the child from crawling and falling from the couch or chair.

Description of the Prior Art

Parents of small children, particularly infants who have progressed to crawling and toddlers just starting to walk, are well aware of the difficulty in keeping track of such children as they begin to explore their surroundings. Not only are there many potentially hazardous areas such children may encounter as they wander through the typical home, but the very act of climbing to or from an article of furniture may result in a fall and injury to the child.

Many parents will place a small child on a sofa, chair, or other furniture, and then become distracted by a visitor, phone call, or other task. Meanwhile, the seated child may attempt to climb down from the couch or other furnishing upon which he or she was placed. While the typical seat of such furniture may only be some eighteen inches or so above the floor, this can be a significant height for a toddler or small child, and such a small child is at risk of potential serious injury from such a fall.

Various restraints exist for infants, toddlers, and small children, ranging from infant seats for automobiles and aircraft, to playpens, to safety straps for use with high chairs, to leashes and harnesses to prevent a child from wandering while the parent or guardian is walking with the child. Yet, no suitable restraint has yet been devised to secure a toddler or small child to an existing article of furniture. Accordingly, a need will be seen for a restraint which may be removably secured to upholstered furnishing without damage thereto. The restraint comprises at least a belt which may be removably secured to an article of furniture, and may include a seat bottom and back portion as well, which may be enclosed in a washable cover, if desired. It should be noted that the present restraint is not adapted to absorb large forces, as might be encountered in a vehicle accident, but the attachment means (pins and/or ties) serve well to secure the restraint adequately to upholstered or other furniture in the home. A discussion of the prior art of which the present inventor is aware, and its differences from the present invention, is provided below.

U.S. Pat. No. 1,373,200 issued on Mar. 29, 1921 to Olaf K. Pacht describes a Seat formed of a single sheet of "stiff fibrous material" (p. 1, 1.67) which is adapted to be secured removably to a vehicle seat and to move unitarily with vehicle motion, rather than having a separate seat bottom and seat back, as in a conventional automobile seat. Straps are used to secure the device between the automobile seat bottom and seat back, and a supplemental retaining flap secures the upper edge of the seat back portion to the vehicle seat back. No restraining strap is disclosed for a person seated thereon, as provided by the present seating restraint, and the stiff material used is unlike the resilient foam or other upholstered material used for the seat bottom and back portions of the present seating restraint.

U.S. Pat. No. 2,851,084 issued on Sep. 9, 1958 to Louis Benjetsky describes a Child's Demountable Auto Seat comprising a unitary seat bottom and seat back formed of rigid and inflexible material, unlike the present seat restraint. The Benjetsky seat cannot be folded, as provided by the present seat. Benjetsky provides additional restrain bars and a chest strap, as well as rigid seat back attachment hooks, all of which are beyond the scope of the present invention, which is adapted only to secure a toddler or small child to a stationary seat in a residence or other fixed structure. Benjetsky must provide a seat which is much stronger structurally, in order to withstand acceleration forces which may be encountered in a collision. The present seating restraint is not adapted for use in automobiles.

U.S. Pat. No. 4,235,474 issued on Nov. 25, 1980 to Linda H. Rosenberg describes a Harness For Retaining A Baby In A Chair, comprising a back portion with an upper pocket adapted to fit over the back of a chair. This arrangement precludes use of the harness on a wider chair, couch, sofa, or the like, as provided by the present seating restraint. The relatively narrow strap which passes beneath the baby and between the legs provides little support for the child, and serves merely as a means of connecting a tie to the device. The tie must be secured behind the chair, rather than at the front of the child, as provided by the present invention. Also, Rosenberg fails to provide any means of attaching the lower portion of her harness to the chair, whereas the present seating restraint secures at the lower back portion thereof or at the juncture of the seat bottom and seat back portions, to better centralize the attachment forces.

U.S. Pat. No. 4,759,588 issued on Jul. 26, 1988 to Monte J. Husnik describes a Seat Belt Training Cushion comprising seat bottom and back portions hinged together. The description of a hinge to secure the two portions together implies the use of rigid materials therefor, unlike the flexible, resilient materials of the present seating. Moreover, Husnik requires use of an existing automobile seat belt assembly to secure the child within his device, as the two arms provided by Husnik are not adapted to restrain the child within the seat, but only to camouflage the automobile belts. Husnik must rely upon the existing automotive belts to secure his device, as he does not provide attachment means.

U.S. Pat. No. 4,874,203 issued on Oct. 17, 1989 to Alvera S. Henley describes a Vehicle Passenger Seat For Handicapped Persons, comprising a rigid structure including a tubular frame and/or rigid sheet metal structure, unlike the foldable, resilient material of the present seating restraint. The Henley seat includes a foot rest in all embodiments, as well as arm rests in at least some embodiments. The device requires a separate anchor in the floor of the vehicle, behind the seat, for attachment of the Henley seat in the vehicle. The present seating restraint requires no additional components secured either to the seating or to the adjacent structure, as required by Henley. Again, the present seating restraint is not adapted for use in an automobile, and thus is considerably lighter and more compact than Henley device.

U.S. Pat. No. 5,354,121 issued on Oct. 11, 1994 to Rita J. Allum describes a Support And Restraint Device For Small Child, comprising a pair of foam cushions removably enclosed in adjoining fabric pockets forming separate seat bottom and seat back portions. Two straps are provided to secure the back portion to a chair. A restraining belt and crotch strap are provided to removably secure a small child to the device, but Allum attaches the crotch strap to the upper surface of the seat cushion or lower belt, rather than to the underside for greater comfort, as in the present invention. The Allum device is unsuited for use on wide and/or upholstered furniture, due to the relatively short attachment straps and lack of provision of pins or the like to secure to an upholstered article, as provided by the present seating restraint.

U.S. Pat. No. 5,499,860 issued on Mar. 19, 1996 to Raymond Smith et al. describes a Collapsible Child Seat having a sleeve secured to the seat back portion, which passes over the back of a chair or other seat to support the device. The seat bottom is suspended from the seat back sleeve portion by a belt which passes beneath the seat bottom. The seat bottom is thus formed of a rigid material, in order to provide such suspension above the supporting chair by the belt from the seat back sleeve. The present seating restraint is adapted to be placed directly upon a chair, couch, sofa, or similar upholstered furniture which may provide sufficient length for seating more than one person. The Smith et al device is not adapted for such use, as the size of the seat back sleeve would prove impractical for attachment to such larger articles of furniture.

British Patent Publication No. 815,007 published on Jun. 17, 1959 to Norman Hartell describes Improvements In Or Relating To Seats For Infants, comprising a rigid tubular frame with laterally adjustable attachment hooks thereon. The frame includes a foot rest, unlike the present seating restraint. Such a depending foot rest would preclude the resting of the bottom portion of the frame and its associated seat bottom directly upon the underlying seat or chair surface, as provided by the present seating restraint. The seat back and bottom portions are apparently formed of hard and rigid sheets of material, as they are described as being padded. It would appear that no such padding would be required for resilient materials.

Finally, British Patent Publication No. 1,176,417 published on Jan. 1, 1970 to Wardour Imports Ltd. describes Improvements In And Relating To Infant Chairs, comprising a steel tube frame having hard plastic seat bottom and seat back panels removably clipped thereto. One embodiment includes a pair of upwardly and rearwardly disposed hooks and is adapted to be supported from a chair back or the like, similarly to other devices discussed above. The use of hooks for support of the device would require at least a rigid frame, if not a rigid seating surface, as the device would be suspended above the seating surface of the supporting chair if the supporting chair has a higher back. No other means is provided to secure the device to a supporting chair or other structure.

SUMMARY OF THE INVENTION

Accordingly, it is a principal object of the invention to provide an improved child's seating restraint which is adapted to be removably secured to a fixed article of furniture and in turn to secure an infant or small child removably thereto.

It is another object of the invention to provide an improved child's seating restraint comprising a belt and crotch strap which restraint may include a seat bottom portion and seat back portion, which portions are formed of a pliable, flexible, and resilient material to provide for the comfort of the child seated therein.

It is a further object of the invention to provide an improved child's seating device which may include a removable cover for the seat bottom and/or seat back portion, which cover is washable.

An additional object of the invention is to provide an improved child's seating restraint which may be secured to the article of furniture by means of pins, ties, or other means which result in no permanent damage to the furniture or requirement for mating attachment means to be applied to the furniture.

It is an object of the invention to provide elements and arrangements thereof in an apparatus for the purposes described which is inexpensive, dependable and fully effective in accomplishing its intended purposes.

It is another object of the present invention to provide anchoring members for anchoring or securing the seat back portion to a rear upholstered portion of a sofa, for example, with the anchoring member including at least one J-shaped hook which fits around the rear upholstered portion to anchor the seating restraint in place.

It is still yet another object of the present invention to include a sheet of material attached to a lower edge of the seat back portion so as to extend down and under a cushion of a couch, for example, so as to trap the sheet of material between the couch cushion and the frame of the couch when a child is sitting in the seating restraint.

It is still yet another object of the present invention to provide a child seating restraint having at least one J-shaped hook extending from a seat back portion for engaging a rear cushion of an upholstered couch so as to anchor the seating restraint on the couch and including a sheet of material extending from a lower edge of the seat back portion so as to pass around and under a cushion of the couch so that the weight of the child sitting in the seating restraint positioned on the couch cushion maintains the position of the sheet of material between the couch cushion and the frame of the couch.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
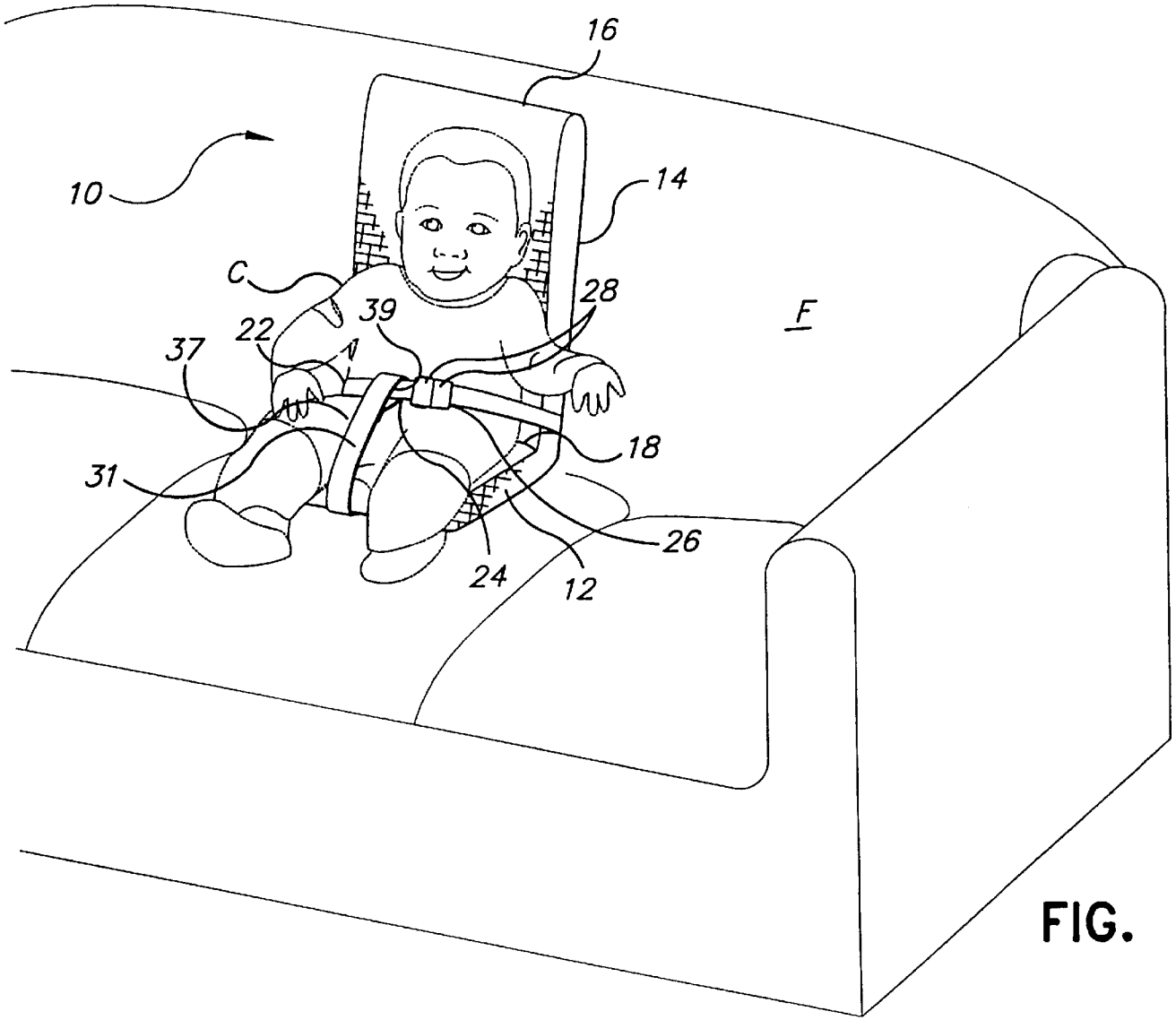
FIG. 1 is an environmental perspective view of the present child's seating restraint, showing its general configuration.
Figure 2:
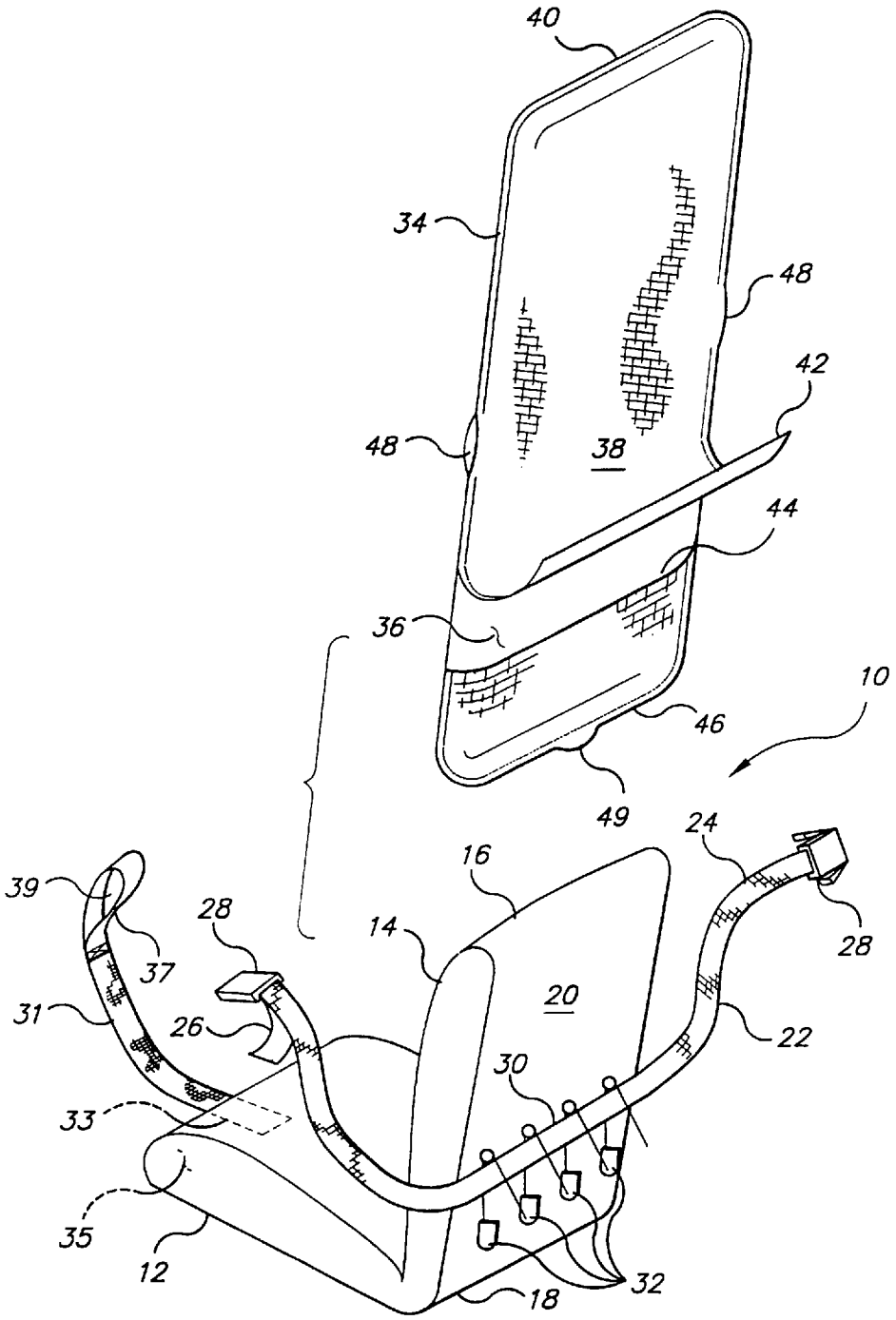
FIG. 2 is an exploded rear perspective view of the child's seating restraint of FIG. 1, showing the removable cover therefor and further details.

The present invention comprises a child's seating restraint, a first embodiment of which is shown in FIGS. 1 and 2 and which is generally designated by the numeral 10. The seating restraint 10 is preferably formed of a single, unitary, generally rectangular, pliable, foldable, and resilient cushion having a seat bottom portion 12 and a seat back portion 14, with the seat back portion 14 having an upper edge 16, an opposite lower edge 18, and a rear surface 20 (FIG. 2). It has been found that a washable closed cell foam plastic material works well for such a seating restraint 10, but other materials (e.g., an envelope filled with cotton or synthetic fiber batting, etc.) may be used as desired.

A single, continuous child restraint belt 22 is secured to the seat back portion 14, with the belt 22 having a first end 24 and an opposite second end 26 each equipped with some form of preferably adjustable mutual attachment means, e.g., mating first and second side latch buckle components 28, or other means as described. The central portion 30 of the restraint belt 22 is preferably secured across the rear surface 20 of the seat back portion 14 of the cushion, adjacent the lower edge 18 of the seat back portion, as shown in FIG. 2. It will be seen that the belt 22 may be secured to the cushion using any one of a number of means, such as stitching, adhesive attachment, or the central portion 30 of the belt 22 may be encapsulated integrally with the cushion when the cushion is formed of a closed cell foam plastic material, as is the case in the preferred embodiments.

Figure 3:
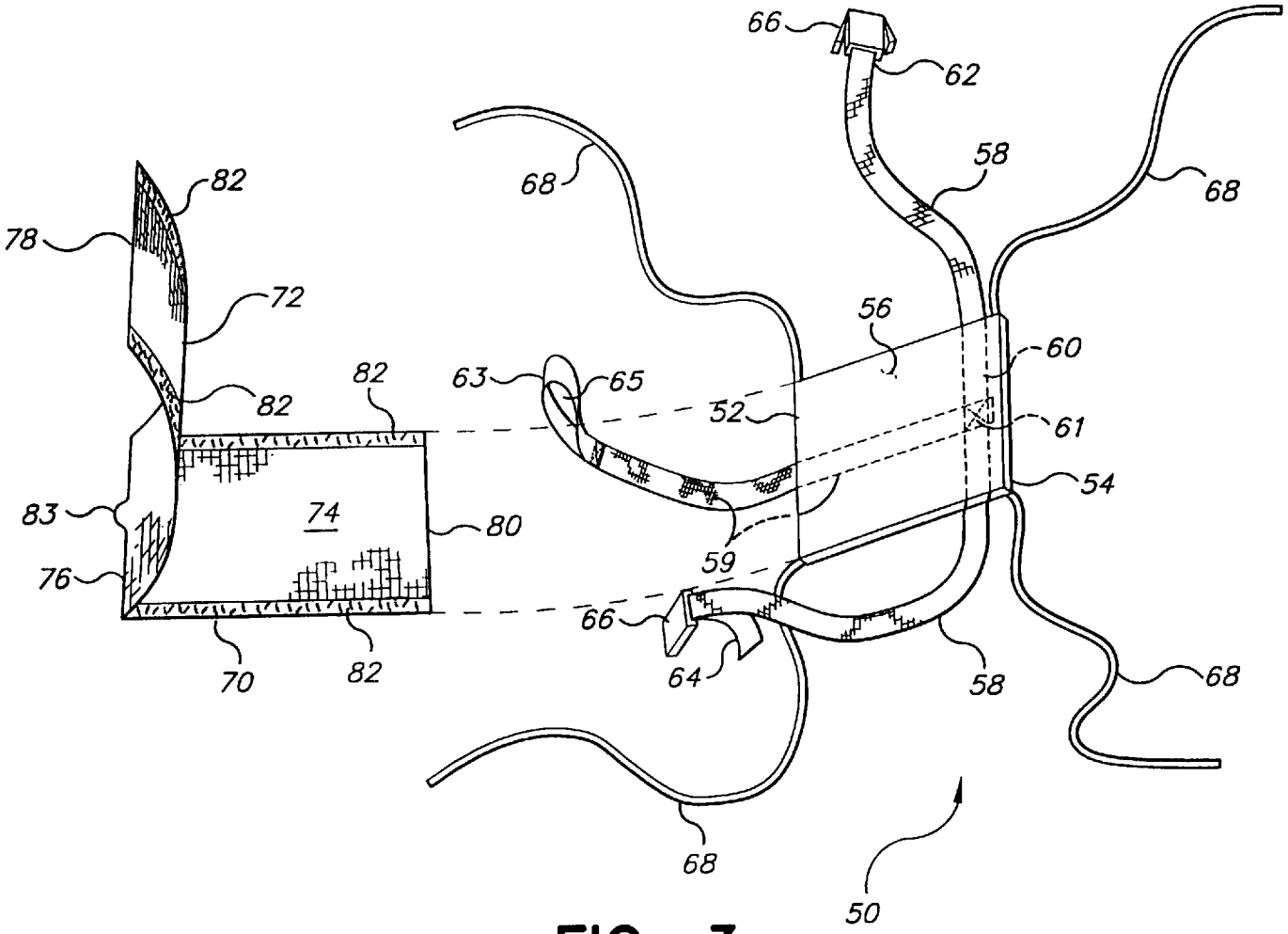
FIG. 3 is an exploded perspective view of an alternate embodiment of the present child's seating restraint, showing details thereof.

A crotch strap 31 has an attachment end 33 which is securely attached (stitching, adhesive, etc.) to the underside 35 of the seat bottom portion 12 of the restraint 10, as shown in FIG. 2. The attachment end 33 may be extended rearwardly to secure to the central portion 30 of the belt 22, if desired, and as shown in the embodiment of FIG. 3. The opposite free end 37 of the crotch strap 31 has a belt passage loop 39 formed therein, providing for the passage of the belt 22 therethrough to prevent a child within the restraint 10 from sliding downward in the restraint 10 when the belt 22 is secured in the manner shown in FIG. 1. The crotch strap 31 may be formed of the same material as the belt 22, e.g., a synthetic woven fabric webbing, or other suitable material as desired.

A series of attachment means or devices is secured generally to the rear 20 of the seat back portion 14 of the cushion, adjacent the lower edge 18 thereof, and extend rearwardly therefrom. A plurality of pins, such as the protected point or safety pins 32 shown in FIG. 2, may be used. Such pins 32 provide for ease of attachment of the present seating restraint 10 to an upholstered stationary article of furniture having a fabric or woven finish, such as the household furniture F of FIG. 1, without damaging or marring the outer finish thereof. The pins 32 may be secured directly to the central portion 30 of the restraining belt 22, thus securing the belt 22 and the cushion to which the belt 22 is secured, to the couch, sofa, or other furniture F. Such safety pins 32 provide a safe means of attachment, as the pin points may be enclosed in the heads of the pins to preclude their working loose and/or allowing a child to injure him/herself inadvertently.

It will be seen that additional furniture attachment means may be added to other portions of the seating restraint 10 if desired, and/or that other types of attachment means (e.g., the ties shown in the embodiment of FIG. 3) may be used in lieu of or in addition to the pins 32 shown in FIG. 2. By using a plurality of pins 32 distributed across the lower rear portion of the cushion, the present seating restraint 10 may be secured to any article of upholstered furniture (couch, sofa, upholstered chair, etc.) regardless of its width, as the attachment means is not dependent upon the width of the furniture. Sufficiently long ties will also suffice for attachment to wider articles of furniture.

FIG. 2 also discloses a removable cover 34 which may be provided for the seating restraint 10, if desired. Preferably, the cover 34 is formed of a washable natural or synthetic fiber fabric material (e.g., cotton, etc.), for comfort and economy. Such fabrics may be washed conventionally with other laundry, as desired. The washable closed cell foam material used for the cushion of the seating restraint may be wiped down easily using soap and water, as required.

The cover 34 of FIG. 2 is formed of congruent first and second sheets of material, respectively 36 and 38, which are secured together (stitched, etc.) along their mutual periphery. The secured periphery is discontinuous, in that they are secured together at their mutual first ends 40 and along the sides or edges adjacent thereto, but the second end 42 of the second sheet 38 comprises a free flap of material which is not directly secured to the first sheet 36. The first sheet 36 includes a pocket 44 extending across the second end 46 thereof, which is adapted to receive the flap 42 of the second sheet 38. Thus, the cover 34 may be opened at the second end(s) thereof, and slipped over the seat bottom and seat back portions 12 and 14 comprising the cushion of the seating restraint 10. The restraining belt ends 24/26 and crotch strap free end 37 are respectively passed through the belt passages 48 and crotch strap passage 49 provided along the peripheral edges of the over 34. The cover pocket 44 is then slipped over the end of the cushion, and the free flap 42 is tucked into the pocket 44 to secure the cover around the cushion. Removal of the cover 34 is essentially the reverse of the above described operation.

FIG. 3 discloses an alternative embodiment of the present restraint, comprising a seat bottom cushion 50 devoid of any back portion. The cushion 50 is formed similarly to the seating restraint cushion 10 of FIGS. 1 and 2, in that it is a generally rectangular, pliable, foldable, resilient unit, preferably formed of a washable closed cell foam plastic material. The cushion 50 includes at least a forward edge 52, a rearward edge 54, and lower surface 56, having a single, continuous child restraint belt 58, similar to the belt 22 of FIGS. 1 and 2 with a central portion 60 secured to the lower surface 56 of the cushion 50 adjacent the rearward edge 54 thereof. The opposite first and second ends 62/64 of the belt 58 may be equipped similarly to the belt 22 of FIGS. 1 and 2, with mating attachment or buckle means 66 extending therefrom to provide for the adjustable closure of the belt 58.

A crotch strap 59 has an attachment end 61, extending beneath the underside 56 of the cushion 50 to secure to the central portion 60 of the belt 58, adjacent the rearward edge 54 of the cushion 50. (The crotch strap 59 may be secured to the cushion underside 56 in lieu of or in addition to its attachment to the belt 58, but mutual attachment of the belt 58 and crotch strap 59 provides greater structural integrity for the cushion restraint embodiment 50.) The crotch strap 59 has an opposite free end 63 including a belt loop 65 formed therein, and functioning similarly to the belt loop 39 of FIGS. 1 and 2.

As in the embodiment of FIGS. 1 and 2, some means must be provided to secure the cushion 50 to an underlying article of furniture. In FIG. 3, a plurality of furniture attachment means comprising a series of elongate ties 68 is provided. These ties 68 may be secured to the cushion 50 adjacent the forward edge 52 and/or rearward edge 54 thereof using attachment means similar to those described further above to secure the belt 22 to the back portion 14 of the seat restraint 10 of FIGS. 1 and 2. The ties 68 may be passed about the structure of the article of furniture to which the cushion 50 is to be secured, and tied in place as desired. It will be seen that the pins 32 of the seating restraint 10 may also be used with the cushion 50 of FIG. 3, if desired.

The cushion 50 of FIG. 3 may also be provided with a removable and washable fabric cover 70 if desired, similar to the cover 34 of the seating restraint 10 of FIGS. 1 and 2. The cover 70 of FIG. 3 is configured somewhat differently than the cover 34 of FIGS. 1 and 2, with the cover 70 being formed of congruent first and second sheets of material 72 and 74, each having a common first end 76 and respective second ends 78 and 80. The remaining free peripheral edges of the two sheets 72 and 74, i.e., those edges not permanently secured together along the common first end 76 of the two sheets 72 and 74, each include some form of mating attachment means 82 disposed therealong, e.g., mating hook and loop fastening material, a zipper, snaps, buttons and buttonholes, etc.

The cover 70 is secured about the cushion 50 by placing the cushion 50 between the two sheets 72 and 74, and securing the edges of the two sheets 72/74 together using the peripheral attachment means 82. A crotch strap passage 83 is provided in the common first end 76 of the cover 70, through which the free end 63 of the crotch strap 59 is passed when the cover 70 is installed over the cushion 50. Alternatively, it will be seen that the cover 70 may be turned around relative to the cushion 50, with the cover open second ends 78 and 80 providing for passage of the crotch strap 59 therebetween.

It will be seen that a zipper type closure would require several such units to provide intermittent gaps for clearance of the ties 68 and restraint belt 58, but that other closure means may be secured about the ties and belt with no problem. It will also be seen that the covers 34 and 70 of the two embodiments may be interchanged with the two cushion embodiments 10 and 50, merely by adjusting the cover length to fit the appropriate cushion 10 or 50 as desired. Also, while it is anticipated that the cushions 10/50 will normally be formed as a flat sheet, as shown in the cushion 50 of FIG. 3, a molded and contoured cushion as shown in FIG. 2 may be provided in either of the embodiments disclosed.

Figure 4:
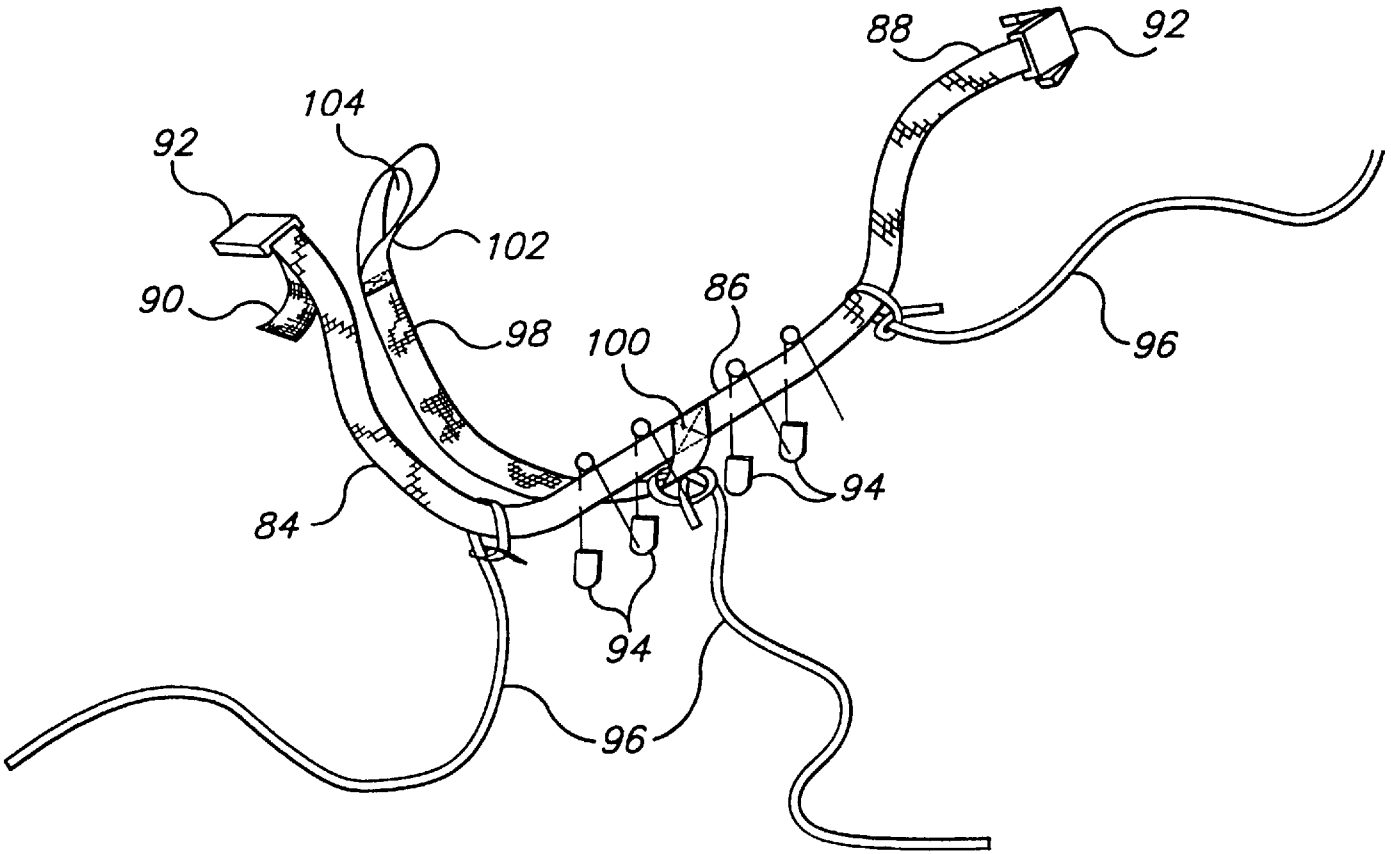
FIG. 4 is a perspective view of a further alternative embodiment, wherein the seat bottom and back portions are deleted.

A further alternative embodiment is disclosed in FIG. 4, wherein the seat bottom and/or seat back cushions, and any cover means therefor, are deleted. In FIG. 4, a single, continuous child restraint belt 84, similar to the belts 22 and 58 of the first two embodiments, includes a central portion 86 and opposite first and second ends 88 and 90. The ends 88/90 of he belt 84 may be equipped similarly to the belt 22 and 58 of FIGS. 1 through 3, with mating attachment or buckle means 92 extending therefrom to provide for the adjustable closure of the belt 84.

The central portion 86 of the belt 84 includes some form of furniture or other article attachment means disposed thereon, such as the plural safety pins 94, and/or ties 96, similar to those means disclosed further above. Either pins 94 or ties 96, or both, may be provided with the belt 84 or with any of the other embodiments of the present invention, as desired.

As in the other embodiments discussed above, the belt 84 includes a crotch strap 98. The strap 98 has an attachment end 100, which is secured (stitching, rivets, etc.) to the central portion 86 of the belt 84, and an opposite free end 102 including a belt passage loop 104 formed therein, and functioning similarly to the belt passage loop 39 of FIGS. 1 and 2 and the belt passage loop 65 of FIG. 3.

The belt 84 is used similarly to the embodiments of FIGS. 1 through 3 discussed further above, by pinning, tying, or otherwise securing the belt 84 to the desired article of furniture, placing the child on the furniture at the location of the secured belt 84, passing one of the belt ends 88 or 90 through the belt passage loop 104 of the crotch strap 98, securing the belt 84 around the child's waist by means of the mating buckle ends 92, and adjusting the belt 84 as required, e.g., by means of the free end 90. The child will thus be held securely in place on the article of furniture to which the waist safety pin 94 and/or ties 96 has been secured by means of the belt 84, and is prevented from sliding downwardly through the belt 84 by means of the crotch strap 98 which is permanently affixed to the belt 84 at one strap end 100, and removably affixed to the belt 84 at the opposite strap end 102. When restraint of the child is no longer necessary, the seating restraint belt 84 may be easily removed by reversing the above steps, i.e., unfastening the latch members 92 from one another, removing the captured portion of the belt 84 from the crotch strap loop 104, and lifting the child free of the restraint. The belt 84 may then be unfastened from the furniture.

Figure 5:
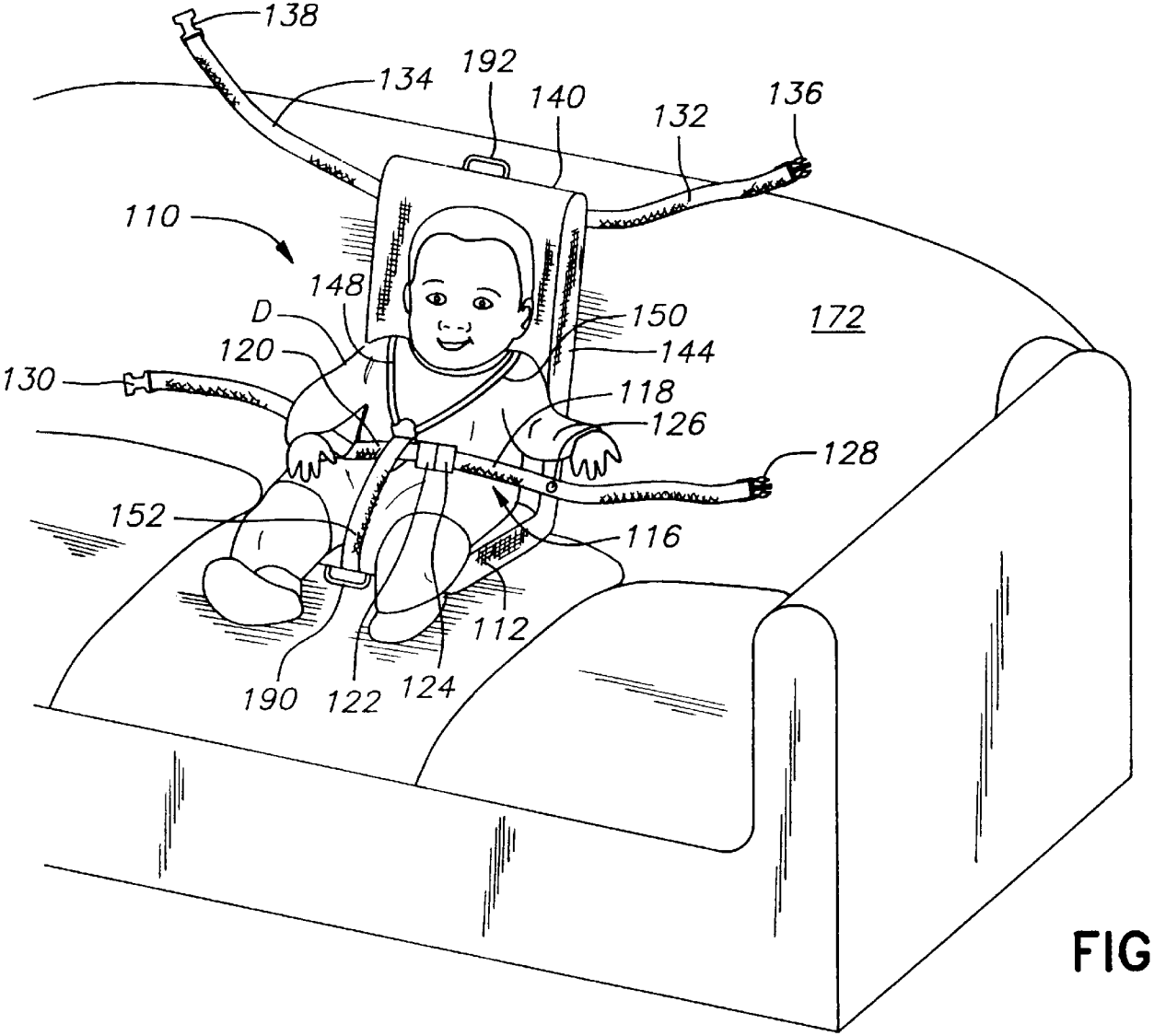
FIG. 5 is an environmental perspective view of the present child's seating restraint showing its general configuration, anchored on an upholstered couch.

In FIG. 5, a seating restraint embodying the teachings of the subject invention is generally designated as 110. The restraint 110 includes a seat bottom portion 112, and a seat back portion 114. The two portions 112, 114 form a single continuous seat for a child D.

The child is restrained by a seatbelt 116 having first portion 118 and a second portion 120 interconnected by buckle portions 122, 124. Belt portion 118 is secured by rivet 126 to the side of the restraint 110. Similarly, belt portion 120 is secured by a rivet (not shown) to the opposite side of the restraint 110.

First portion 118 continues and terminates in a buckle portion 128 for interengagement with a buckle portion 130 at the terminal end of second portion 120 for wrapping around an un-upholstered chair, for example. Similarly, safety belt portions 132, 134, terminating in buckle portions 136, 138, respectively, are for securing an upper portion 140 of seat back portion 114 to an un-upholstered chair, for example. The ends of belt portions 132, 134 are riveted to the rear surface 142 of the restraint 110 by rivets 144, 146, respectively.

To aid in restraining a child on the restraint 110, a pair of shoulder straps 148, 150 cooperate with a crotch strap 152 for holding a child on the restraint 110.

Figure 6:
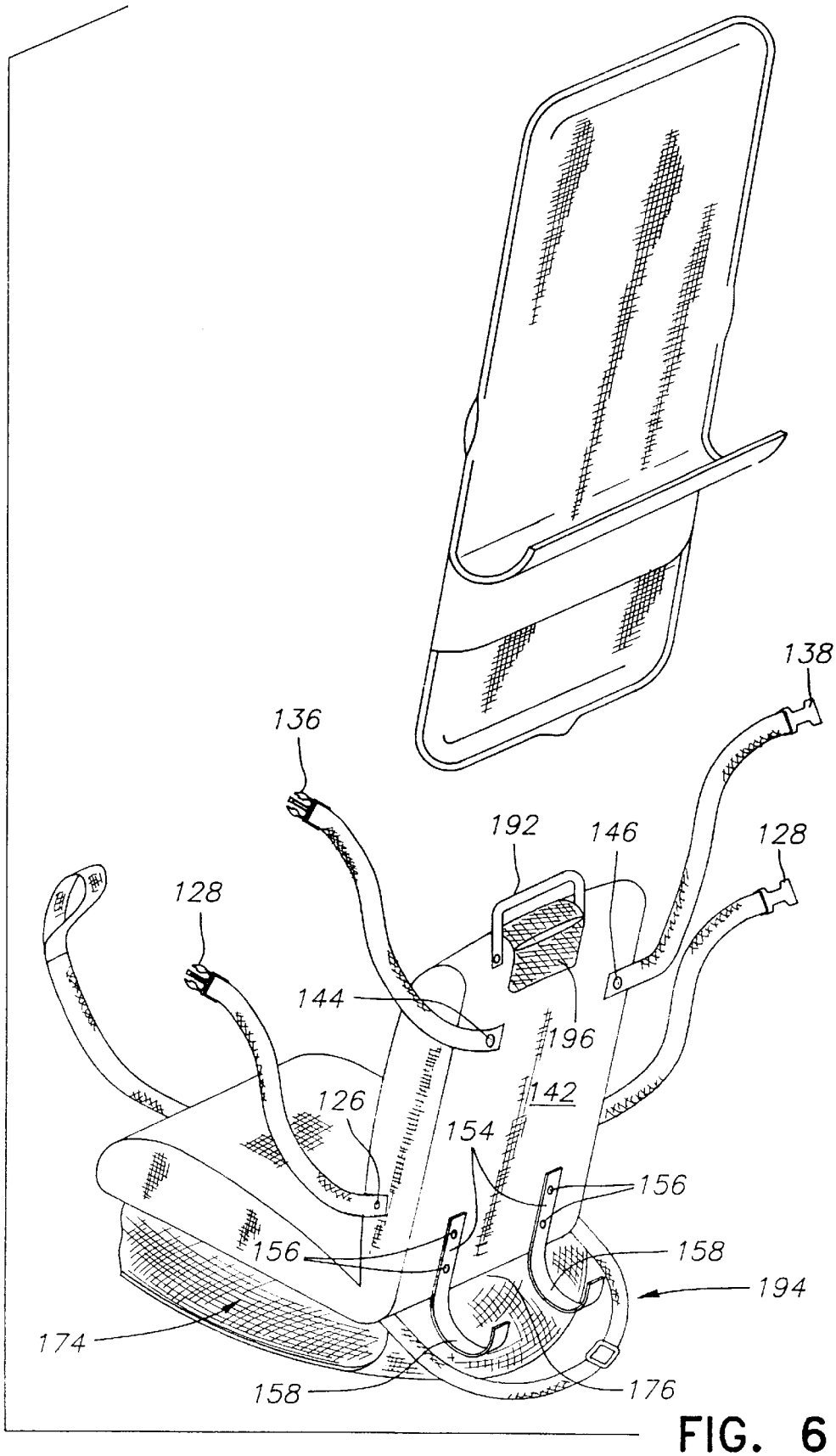
FIG. 6 is an exploded rear perspective view of the child's seating restraint of FIG. 5, showing a removable cover and J-shaped hooks projecting from the rear surface of the seat back portion.

With reference to FIG. 6, two J-shaped hooks 154 located on lateral sides of rear surface 142 are secured at their elongated portions by rivets 156. The free ends 158 of the hooks 154 project rearwardly and then upwardly with respect to the rear surface 142 of the restraint 110. It is envisioned as being within the scope of the present invention that the two hooks 154 and the space between them may be occupied by a single continuous rigid sheet of plastic formed in a J-configuration.

Figure 7:
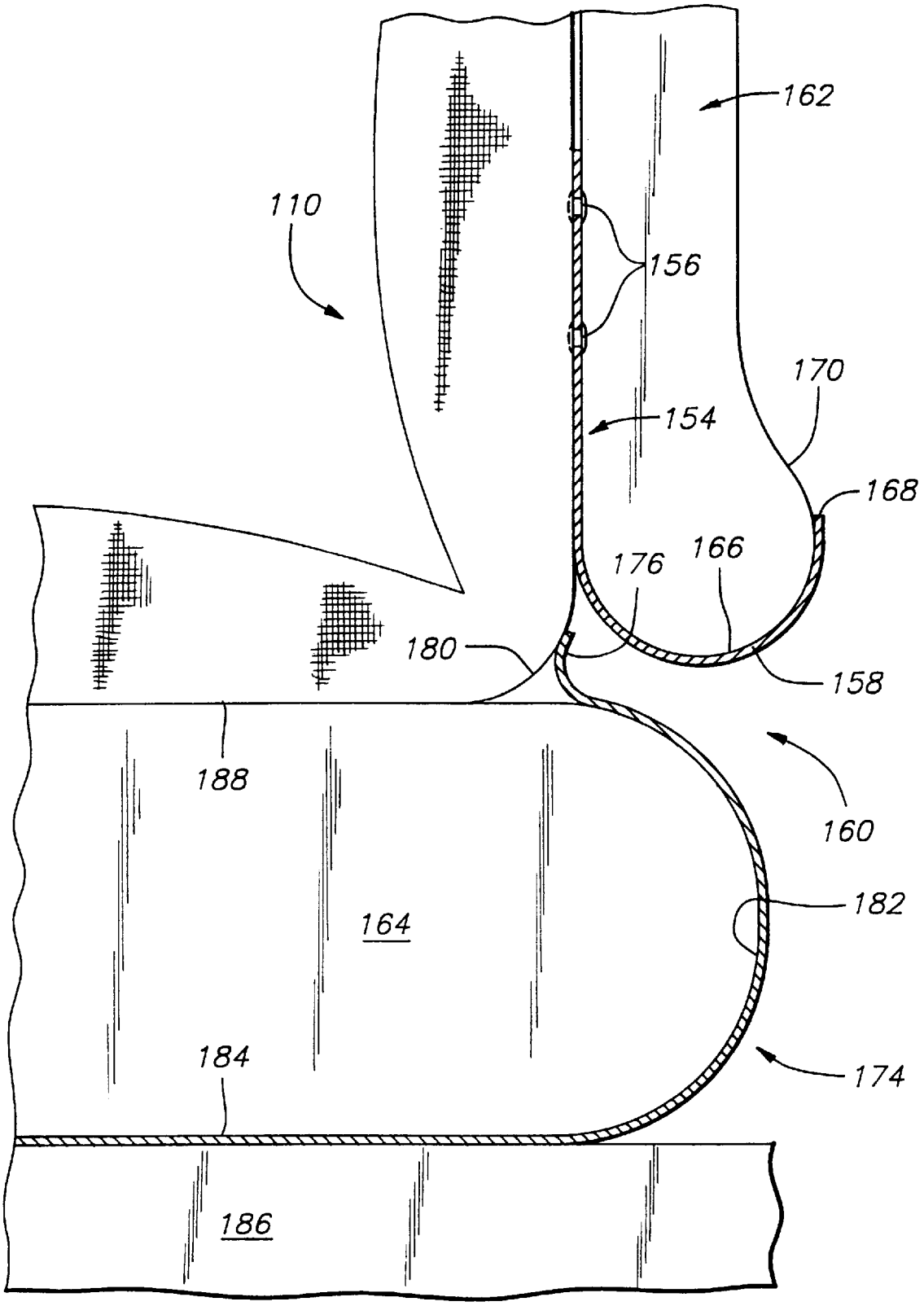
FIG. 7 is an enlarged sectional view illustrating the interaction of the J-shaped hooks of the seat back portion engaging the rear portion of a couch and a sheet of material attached at a lower edge of the seat back portion and extending downwardly and around the couch cushion, between the couch cushion and the frame of the couch for anchoring the seating restraint when a child is sitting in the seating restraint.

In use, as shown in FIG. 7, the restraint 110 is anchored to a couch by forcing the hooks 154 into a gap 160 formed between a rear upholstered cushion 162 of a couch 172 and a seat cushion 164. After passing through the gap 160, and upon application of continued pressure, the free end 158 is located to extend around the lowermost edge 166 of the rear seat cushion 162 so that the terminal end 168 of the hooks passes around and engages a rear surface 170 of the rear seat cushion 162. The seating restraint 110 is thereby anchored in position on the couch 172, as shown in FIG. 5.

As an alternative, or in combination with the hooks 154, a sheet of material 174 may be anchored by its edge 176, to a lower edge 180 of the rear surface 142. The length of the sheet of material 174 is sufficient such that in use, as shown in FIG. 7, the sheet of material extends rearwardly, downwardly and then forwardly around the rear edge 182 of the cushion 164 and along the bottom edge 184 of the seat cushion 164. The sheet of material is thereby trapped between the seat cushion 164 and the frame 186 of the couch 172.

When the child D is sitting in the seating restraint 110, the weight of the child on the seating restraint, located on the upper surface 188 of the couch seat cushion 164, is applied to the sheet of material 174 extending between the couch cushion 164 and couch frame 186. The weight anchors the sheet of material 174 in place and thereby prevents the seating restraint 110 from being dislodged from the upper surface 188 of the couch seat cushion by the movement of the child.

For convenience, in addition to two carrying handles 190 and 192 secured to the seat bottom portion 112, and the seat back portion 114, respectively, a carrying strap 194 is provided so that the seating restraint 110 may be carried by the strap 194 about the shoulder of a parent or guardian. In addition, a mesh pocket 196 is provided along an upper edge of the rear surface 142 for storing items that need to be close at hand for a child.

The present child's seating restraint, in any of its embodiments, will be seen to provide a most useful accessory for a person caring for a toddler or small child who is just beginning to develop mobility. The restraint may be secured easily to an article of furniture F, as shown in FIG. 1, by means of the pin attachments shown in FIGS. 2 and 4 or the alternative ties disclosed in FIGS. 3 and 4. As with various other components of the present invention, the various attachment means disclosed may be applied to either of the two cushion embodiments or the belt embodiment disclosed herein. At this point, the infant, toddler, or small child C may be placed upon the seat bottom portion of the cushion and secured thereto, or placed directly upon the furniture and secured thereto, using the restraining belt and buckle arrangement disclosed. The parent or guardian of the child may then feel free to devote attention to other chores, without having to provide constant attention to the child to monitor his or her location and actions.

When the seating restraint is no longer required (as at the child's nap or bed time, meal time, etc.) the cover (if provided) may be quickly and easily removed and thrown in the wash, with other laundry. The embodiments incorporating a foam cushion may be easily wiped down as required, with the cover (if provided) quickly and easily reinstalled after cleaning. The present child's seating restraint, in any of its embodiments, is very light in weight and economical, and may be easily folded or rolled for storage as desired when not needed. Parents and guardians of small children will find the present child's seating restraint to be a most valuable article to assist them in caring and providing for children in their care.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A child's seating restraint comprising:

a cushion having a seat bottom portion and a seat back portion, with said seat back portion having an upper edge, an opposite lower edge, and a rear surface, a child restraint belt for restraining a child on said cushion, a crotch strap having an attachment end secured to said seat bottom portion therebeneath, and an opposite free end cooperating with said restraint belt for restraining a child, and at least one furniture anchoring member extending rearwardly at least from said seat back portion adjacent said lower edge and up along said seat back portion, with said at least one furniture anchoring member providing for removable anchoring of said child's seating restraint to a stationary article of furniture.

2. The child's seating restraint according to claim 1, wherein said at least one furniture anchoring member is a J-shaped hook.

3. The child's seating restraint according to claim 1, wherein said cushion is washable.

4. The child's seating restraint according to claim 1, wherein said cushion is formed of closed cell foam plastic material.

5. A child's seating restraint according to claim 1, wherein there are at least two furniture anchoring members.

6. The child's seating restraint according to claim 1, including a cover removably installable over said seat back portion and said seat bottom portion.

7. A child's seating restraint according to claim 6, wherein said cover comprises a congruent first and second sheet of material each having a first end and a second end, with each said sheet being secured together along each said first end thereof, said first sheet and said second sheet each having a partial free peripheral edge, with each said edge including mating attachment elements disposed therealong providing for the closure of said cover about said cushion.

8. The child's seating restraint according to claim 6, wherein said cover is formed of a washable fabric material.

9. The child's seating restraint according to claim 6, wherein said cover comprises a first sheet of material with a congruent second sheet of material secured peripherally and discontinuously thereto, and each said sheet having a first end and an opposite second end, with said first end of said first sheet having a pocket extending thereacross and said first end of said second sheet comprising a free flap adapted to be selectively tucked within said pocket to secure said cover about said cushion.

10. A child's seating restraint comprising:

a cushion having a seat bottom portion and a seat back portion, with said seat back portion having an upper edge, an opposite lower edge, and a rear surface, a child restraint belt for restraining a child on said cushion, a crotch strap having an attachment end secured to said seat bottom portion therebeneath, and an opposite free end cooperating with said restraint belt for restraining a child, at least one furniture anchoring member extending rearwardly at least from said seat back portion adjacent said lower edge thereof, with said at least one furniture anchoring member providing for removable anchoring of said child's seating restraint to a stationary article of furniture, and a cover removably installable over said seat back portion and said seat bottom portion, said cover including a first sheet of material with a congruent second sheet of material secured peripherally and discontinuously thereto, and each said sheet having a first end and an opposite second end, with said first end of said first sheet having a pocket extending thereacross and said first end of said second sheet having a free flap adapted to be selectively tucked within said pocket to secure said cover about said cushion.

11. A child's seating restraint comprising:

a seat bottom cushion with said cushion having a forward edge, an opposite rearward edge, and a lower surface, a child restraint belt for restraining a child on said cushion, a crotch strap cooperating with said restraint belt, and at least one furniture anchoring member including a flexible sheet of material extending rearwardly at least from said cushion adjacent said rearward edge and along said seat bottom cushion, with said furniture anchoring member providing for the removable anchoring of said child's seating restraint to a stationary article of furniture, held in place by the weight of the child sitting on the seat bottom cushion.

12. A child's seating restraint comprising:

a cushion having a seat bottom portion and a seat back portion, with said seat back portion having an upper edge, an opposite lower edge, and a rear surface, a child restraint belt for restraining a child on said cushion, a crotch strap having an attachment end secured to said seat bottom portion therebeneath, and an opposite free end cooperating with said restraint belt for restraining a child, at least one furniture anchoring member extending rearwardly at least from said seat back portion adjacent said lower edge thereof, with said at least one furniture anchoring member providing for removable anchoring of said child's seating restraint to a stationary article of furniture, and a cover removably installable over said seat back portion and said seat bottom portion, said cover including a congruent first and second sheet of material each having a first end and a second end, with each said sheet being secured together along each said first end thereof, said first sheet and said second sheet each having a partial free peripheral edge, with each said edge including mating attachment elements disposed therealong providing for closure of said cover about said cushion.

* * * * *